US005525076A

United States Patent [19]

Down

[11] Patent Number: 5,525,076

[45] Date of Patent: Jun. 11, 1996

[54] LONGITUDINALLY COMPRESSIBLE COAXIAL CABLE CONNECTOR

[75] Inventor: William J. Down, Phoenix, Ariz.

[73] Assignee: Gilbert Engineering, Glendale, Ariz.

[21] Appl. No.: 346,381

[22] Filed: Nov. 29, 1994

[51] Int. Cl.[6] ..... H01R 13/00

[52] U.S. Cl. ..... 439/585; 439/578; 439/877

[58] Field of Search ..... 439/578, 584, 439/585, 877

[56] References Cited

U.S. PATENT DOCUMENTS 4,135,776 1/1979 Ailawadhi et al. ..... 439/585
4,583,811 4/1986 McMills ..... 439/584
4,921,447 5/1990 Capp et al. ..... 439/585
5,066,248 11/1991 Gaver, Jr. et al. ..... 439/578

FOREIGN PATENT DOCUMENTS 1921200 11/1970 Germany ..... 439/585

*Primary Examiner* P. Austin Bradley
*Assistant Examiner* Jill DeMello
*Attorney, Agent, or Firm* Parsons & Associates; Don J. Flickinger; Robert A. Parsons

[57] ABSTRACT

A connector (20, 90) for securing the end of a coaxial cable (30, 140) to a selected device in a cable transmission system includes an outer member (40, 60, 92), a coupling member (23, 107) attached to an end thereof, and a securement means for mechanically and sealably engaging coaxial cable (30, 140).

9 Claims, 3 Drawing Sheets

LONGITUDINALLY COMPRESSIBLE COAXIAL CABLE CONNECTOR

TECHNICAL FIELD

This invention relates to cable transmission systems.

More particularly, the present invention relates to connectors of the type normally used to connect coaxial cable to devices within a cable transmission system.

In a further and more specific aspect, the instant invention concerns improvements for securing a connector to a coaxial cable.

PRIOR ART

Cable transmission systems for the transfer of signals between devices are well-known. Exemplary systems are cable antennae television (CATV) and local area networks (LAN). Generally included are remotely located primary devices such as a central computer and terminals in a LAN system, or an antennae and receiver sets in a CATV system. Intermediate the primary devices, the typical system may also include various auxiliary devices, such as couplers, directional taps, and amplifiers.

Coaxial cable provides signal communication among several devices in a system. Commercially available coaxial cable includes a center conductor and an outer conductor separated and insulated by a dielectric and encased in a protective jacket. The conductive elements are commonly fabricated of metal, such as copper or aluminum. Polyethylene and polyvinyl chloride (PVC) are usually materials for the non-conductive components.

Characteristically, the center conductor is a solid wire which is coaxially carried with in the cylindrical dielectric. The outer conductor includes two elements, a foil sheath encasing the dielectric and a pliant wire braid woven above the foil sheath. The tubular protective jacket x snugly embraces the wire braid. Numerous connectors are used throughout a typical cable transmission system. A connector, for example, is interposed between each of the several devices and the respective cable. One end of a connector is mechanically and electrically securable to the cable end, while the other end is especially adapted for attachment to the device.

Conventional means for securing the cable includes a pair of coaxial tubular member extending from the body of the connector. The outer tubular member is a relatively thin-walled structure of uniform thickness defined by inside and outside surfaces which are sections of concentric right cylinders. The inner tubular member is similarly structured. Gripping means, such as annular ridges, are usually formed on the outside surface of the inner tubular member. Gripping means on the inside surface of the outer tubular member is also known.

During assembly, the end of the cable is inserted into the outer tubular member while simultaneously the inner tubular member is forced between the dielectric and the outer conductor. Subsequently, the outer tubular member is compressed, captivating the jacket and the outer conductor between the tubular members and embedding the gripping means into the adjacent portion of the cable. Generally, a hexagonal crimping tool is utilized to apply a compression force to the outer tubular member, deforming in to a predetermined configuration and measurement.

There are several inherent problems using a connector of this sort. First, the hexagonal crimping tool does not apply a uniform compression force on the outer tubular member. Rather, the hexagonal crimp leaves several uncompressed or partially compressed zones between the outer tubular member and the jacket of the coaxial cable. These zones are possible avenues of moisture infiltration, and are weak areas in the connection. Infiltrated moisture may eventually contact the braided shields and degrade the signal transmission performance of the connector.

To partially overcome these problems associated with hexagonal crimping, a prior art connector has been developed which includes a connector body having an annular collar member which peripherally engages the jacket of a coaxial cable, a post member coaxially disposed within the annular collar member to engage the dielectric insulation and the braided shield of the coaxial cable, and a rotatable nut member disposed in combination with the collar and post member. A compression sleeve is configured for snap fitting engagement between the jacket of the coaxial cable and the annular collar member.

The coaxial cable is inserted through the sleeve, and into the connector body. The sleeve, which is a separate piece, is then snapped into the connector body. While this forms a moisture seal between the coaxial cable and the connector, this solution requires the installation of an additional element with the associated cost and time considerations as well as the potential for loss of one of the elements. Furthermore, while the sleeve is securely snapped into engagement with the connector body, the coaxial cable has not been crimped in place, but has only been compressed between the sleeve and the post member during insertion of the sleeve.

Coaxial cable is commercially available in various nominal sizes or series, each embracing several specific outside diameters. To insure proper securement between the cable and the connector, usually forty pounds minimum tensile strength, the prior art has resorted to an elaborate scheme. The scheme requires that each connector be available with numerous outer tubular members in an assortment of specific sizes to closely receive a respective cable of particular diameter. Since each tubular member must be compressed in accordance with predetermined standards, it is necessary that crimp tools be equally as numerous.

The elaborate prior art schemes has placed an undo burden upon all concerned. Each of the myriad of commonly recognizable connectors must be manufactured with numerous alternate outer tubular members. The manufacturer must also provide a crimp tool for each outer tubular member. Correspondingly, suppliers and installers are encumbered with ponderous inventory. Ultimately, the resulting financial burden is borne by the consumer.

DISCLOSURE OF INVENTION

It would be highly advantageous, therefore, to remedy the foregoing and other deficiencies inherent in the prior art.

Accordingly, it is an object of the present invention to provide improvements in connectors of the type especially adapted for use in cable transmission systems.

Another object of the present invention is the provision of improved means for securing a connector to a coaxial cable.

And another object of the present invention is to provide a connector which grips the coaxial cable around its entire circumference.

Yet another object of the present invention is to provide a securement means that can accommodate more than one specific size of cable.

Still another object of the present invention is to provide a securement means which employs a very high contact pressure in the sealing area.

Yet still a further object of the present invention is to provide a connector with sealing means in a one piece construction And a further object of the instant invention is to provide a moisture seal without the use of O-rings.

Still a further object of the present invention si to provide a securement means that can be affixed to more that one six of cable with a single crimp tool.

Yet a further object of the present invention is to provide improvements which may assume alternate forms at the option of the manufacturer.

And yet a further object of the present invention is to provide a connector with sealing means having an all metal construction.

Briefly, to achieve the desired objects of the instant invention in accordance with a preferred embodiment thereof, provided is a connector including an outer tubular member having an axial bore for receiving a coaxial cable, a free end, and an inner end. A coupling member is attached to the inner end of the outer tubular member for coupling the coaxial cable to a wide variety of various devices and including splicing coaxial cables. A securement means is carried by the outer tubular member for providing mechanical, and sealing engagement with the coaxial cable, in response to a longitudinal compressive force.

BRIEF DESCRIPTION OF THE DRAWINGS

The foregoing and further and more specific objects and advantages of the instant invention will become readily apparent to those skilled in the art from the following detailed description of the preferred embodiment thereof taken in conjunction with the drawings in which.

BEST MODES FOR CARRYING OUT THE INVENTION

Figure 1:
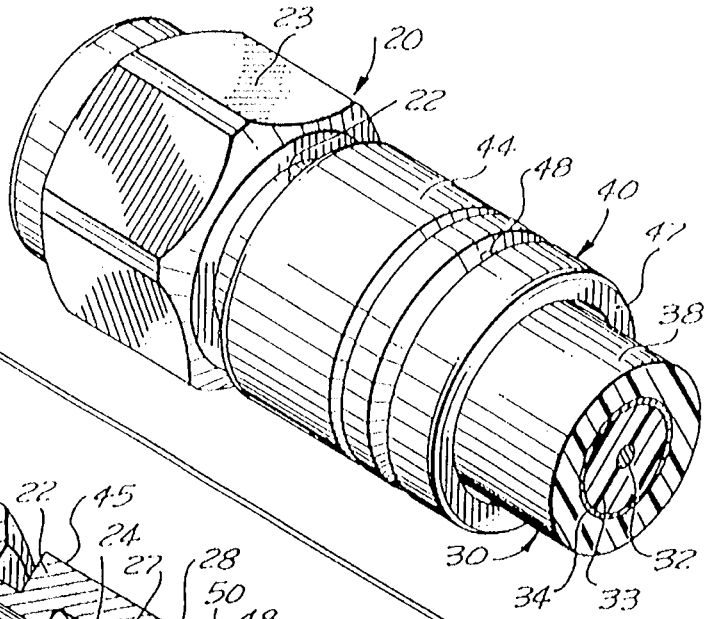
FIG. 1 is a perspective view of a coaxial connector as it would appear coupled to a coaxial cable.
Figure 2:
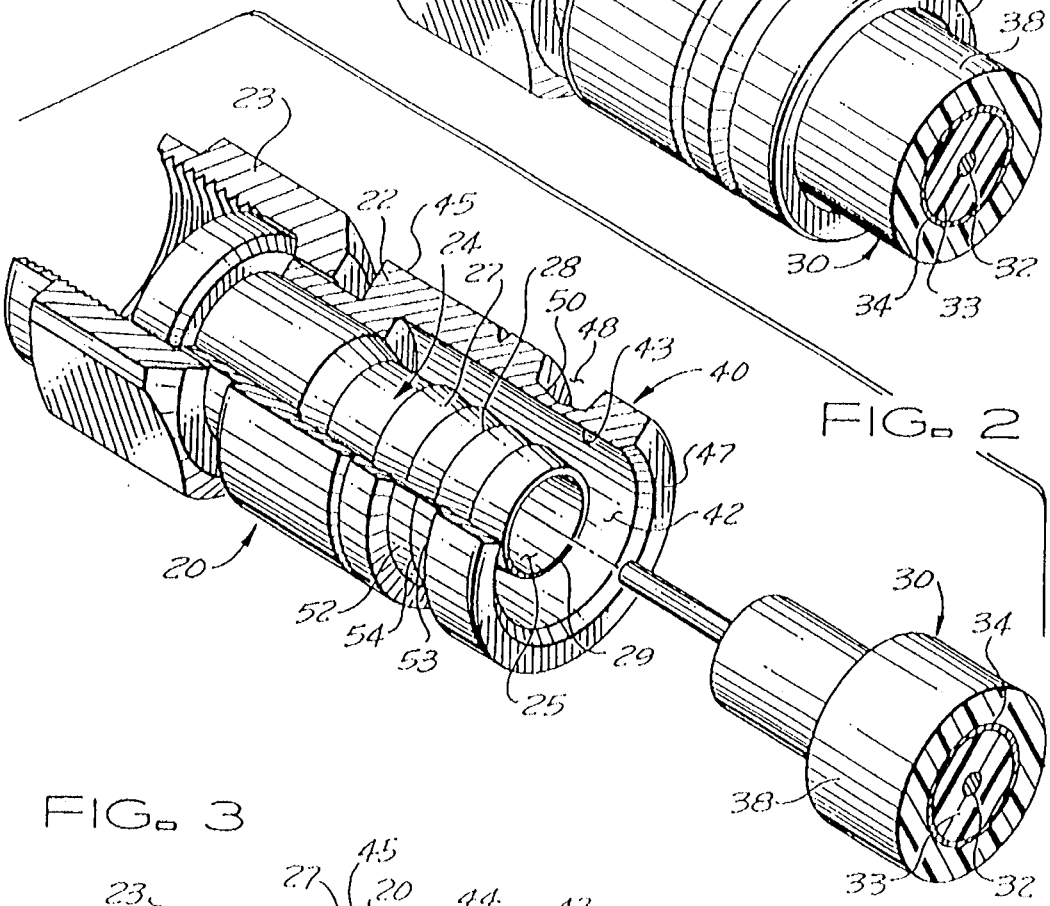
FIG. 2 is a cut-away perspective view of the coaxial cable and coaxial cable connector illustrated in FIG. 1.

Turning now to the drawings in which like reference numerals indicate corresponding elements throughout the several views, attention is first directed to FIGS. 1 and 2 which illustrates a cable connector generally designated by the reference character 20 incorporating improved cable securement means embodying the teachings of the instant invention. In accordance with the conventional prior art, connector 20 includes an electrically conductive body 22 usually fabricated of a metal such as brass or aluminum A nut 23, rotatably carried by body 22, functions as a connection member for detachable union with a selected device within a cable transmission system. An elongate inner tubular member 24, having axially extending bore 25 and coaxial cylindrical outer surface 27, extends from body 22 in a direction opposite nut 23. Commonly, inner tubular member 24 terminates with a free end 29.

A conventional coaxial cable generally designated by the reference character 30, including a center conductor encased in a cylindrical dielectric 33 is illustrated in FIG. 2. An outer conductor 34, typically including an inner foil sheath and an outer braid of woven pliant wire, encircles dielectric 33. A jacket 38 encircles outer conductor 34 and functions as the outer protective component.

The foregoing description of cable 30 and of the prior art components of connector 20 are set forth herein for purposes of orientation and reference in connection with the ensuing detailed description of the improved cable securement means of the instant invention. Further and more specific details not described not illustrated will be readily appreciated by those skilled in the art.

Provided by the instant invention is an elongate outer tubular member, generally designated by the reference character 40, which is preferably fabricated with body 22 to extend coaxial with inner tubular member 24. Outer tubular member 40 includes a bore 42, an inner surface 43 and an outer surface 44. Longitudinally, outer tubular member 40 extends between an inner end 45 at the junction with body 22 and a free end 47. In this embodiment, a coupling member nut 23, is attached to inner end 45 of outer tubular member 40 by body 22. However, those skilled in the art will understand that attachment means other than body 22 may be used to attach a coupling member to inner end 45 of outer tubular member 40, and that coupling members other than nut 23 may be attached to inner end 45 of outer tubular member 40.

In accordance with the immediately preferred embodiment of the instant invention, inner surface 43 is cylindrical and of a substantially uniform diameter.

Outer surface 44 is of a substantially uniform diameter, with a compression groove 48 inscribed therein intermediate inner end 45 and free end 47. Preferably, compression groove 48 is positioned closer to free end 47. A bottom 50 of groove 48 has inward sloping sides 52 and 53. Sides 52 and 53 slope inwardly toward bore 42 to a central joint 54. In this embodiment, compression groove 48 and bottom 50 are the securement element for forming a mechanical and sealing engagement with coaxial cable 30.

Figure 3:
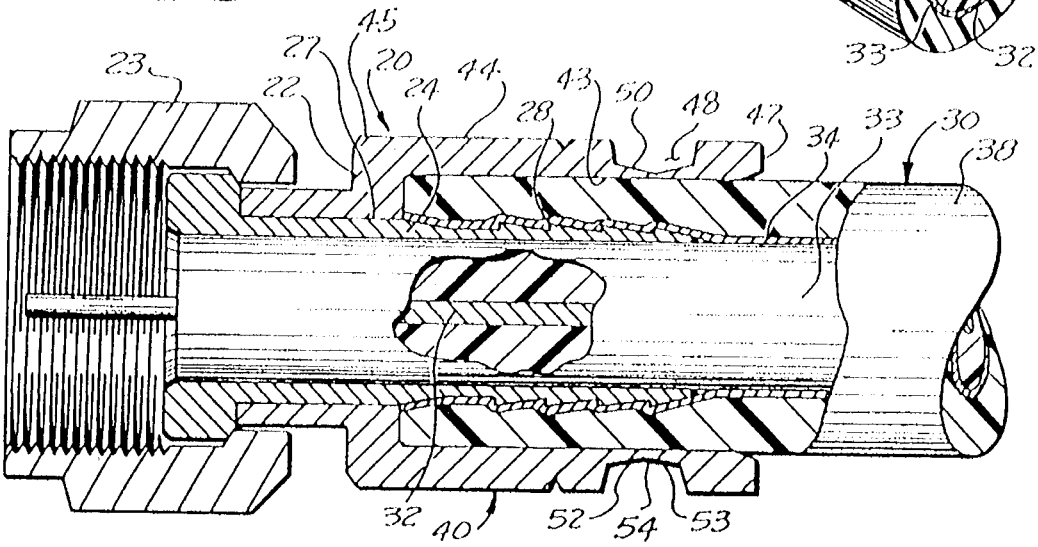
FIG. 3 is a cross-sectional side view of the coaxial cable connector illustrated in FIG. 1, with an unsecured coaxial cable inserted therein.

The securement of connector 20 incorporating the previous described embodiment of the instant invention with cable 30 requires the preparation of the end of cable 30 in accordance with the teachings of the prior art. Connector 20 is then joined with cable 30 during which cable 30 is received within bore 42 of outer tubular member 40 and inner tubular member 24 being received between dielectric 33 and outer conductor 34 as seen in FIG. 3.

Figure 4:
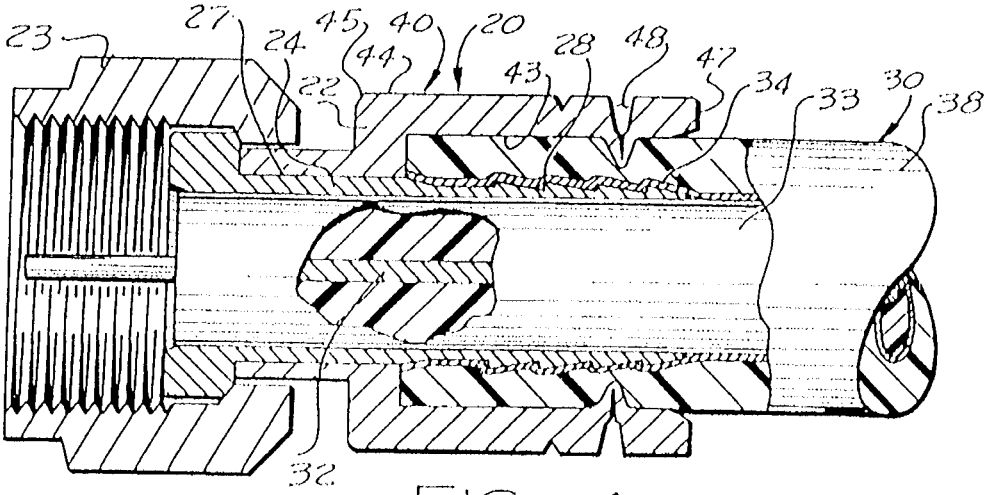
FIG. 4 is a cross-sectional side view similar to FIG. 3, with the coaxial cable held securely in place by the securement means.

With reference to FIG. 4, cable 30 is held in mechanical and sealing engagement with connector 20 in response to the application of a longitudinally directed compression force applied to free end 47 of outer tubular member 40. A longitudinal compression force applied to free end 47 of outer tubular member 40 results in the inward collapse of bottom 50 along central joint 54. As free end 47 is longitudinally compressed toward inner end 45, inner surface 43 is deformed substantially uniformly radially inward, with sides 52 and 53 projecting inwardly substantially reducing the diameter of inner surface 43 at this point, mechanically engaging jacket 35 around its entire circumference. Inwardly projecting sides 52 and 53 form a very effective moisture seal with jacket 35, preventing moisture from entering connector 20.

The prior art requires an outer tubular member of specific dimension for each different diameter of cable within a series. Each is then compressed within a corresponding crimp cavity. In a cable series having a variety of specific diameters, a number of different sized outer tubular members and crimp cavities are necessary. By comparison, the improved securement means of the instant invention in accordance with the foregoing description will accommodate a variety of different diameter cables, since the application of a greater longitudinal compression force will result in sides 52 and 53 projecting further into bore 42. This will allow smaller diameter cables to be accommodated in the same size connector 20.

Figure 5:
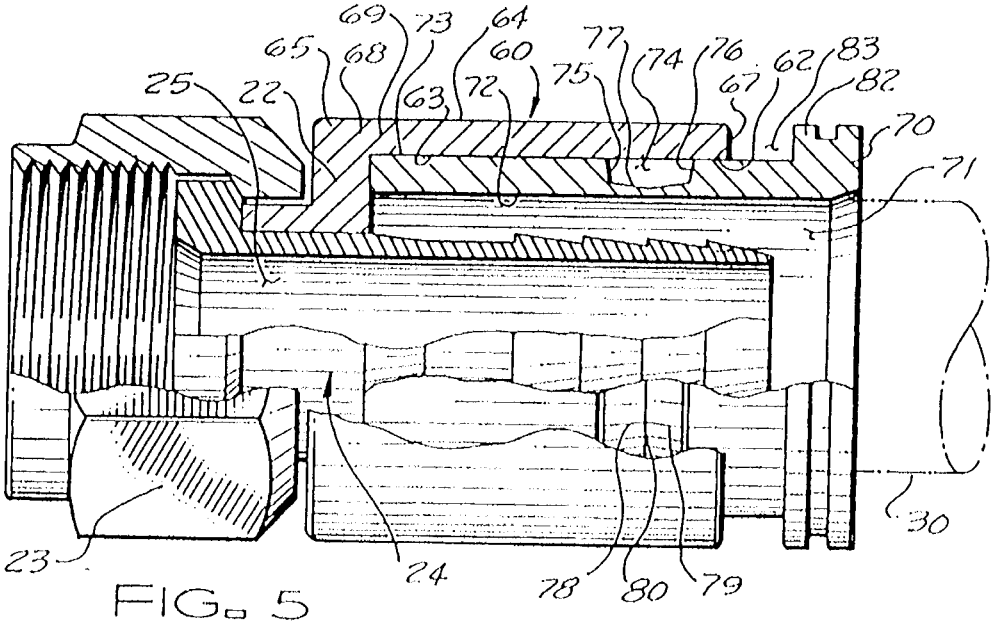
FIG. 5 is a cross-sectional side view of an alternate embodiment of a coaxial cable connector.

Referring now to FIG. 5, an alternate embodiment of the instant invention including an outer tubular member generally designated by the reference character 60 is illustrated. Constructed in accordance with the teachings of the instant invention and in general similarity to previously described outer tubular member 40, outer tubular member 60 includes a bore 62, an inner surface 63, an outer surface 64, inner end 65 and free end 67. In this embodiment, inner and outer surfaces 63 and 64 are generally cylindrical and each are of substantially uniform diameter.

Securement means, being a generally cylindrical body 68, having an inner end 69, an outer end 70, an inner surface 72 defining a bore 71 and an outer surface 73, is carried by outer tubular member 60. Inner surface 72 is generally cylindrical and of a substantially uniform diameter. Outer surface 73 is generally cylindrical, has a substantially uniform diameter, and includes a compression groove 74 intermediate inner end 69 and outer end 70. Compression groove 74 is defined by sidewall 75 and 76 extending around the circumference of outer surface 73, and a bottom 77 extending between sidewalls 75 and 76. Bottom 77 includes a first half 78 and a second half 79, each extending from sidewalls 75 and 76, respectively, and sloping inward toward inner surface 72. First half 78 and second half 79 join at a central joint 0 midway between sidewalls 75 and 76. An annular flange 82 extends radially outward from outer surface 73 proximate outer end 70.

Cylindrical body 68 extends from body 22 along inner surface 63 of outer tubular member 60. In its uncompressed configuration, cylindrical body 68 extends past free end 67 of outer tubular member 60, with a gap 83 defined by free end 67 of outer tubular member 60 and annular flange 83 of cylindrical body 68. In this embodiment, cylindrical body 68 is press-fit into outer tubular member 60, with outer surface 73 of cylindrical body 68 flush with inner surface 63 of outer tubular member 60.

Figure 6:
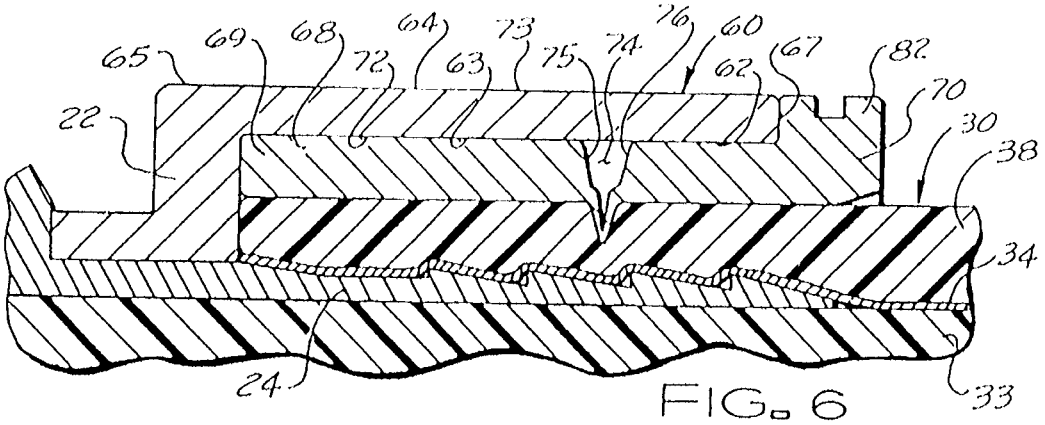
FIG. 6 is a fragmentary cross-sectional side view of the coaxial cable connector illustrated in FIG. 5 with a coaxial cable securely coupled therewith.

The attachment of the immediate embodiment of the instant invention to coaxial cable 30 is analogous to the attachment of the embodiment designated by the reference character 40 with the exception being that outer end 70 of cylindrical body 68 is actually compressed towards inner end 69 as illustrated in FIG. 6. Depending upon the diameter of coaxial cable 30, annular flange 82 is moved toward free end 67 of outer tubular member 60 reducing gap 83. The compression of cylindrical body 68 results in halves 78 and 79 of bottom 77 extending substantially uniformly radially inward, deforming inner surface 72 into jacket 35.

Figure 7:
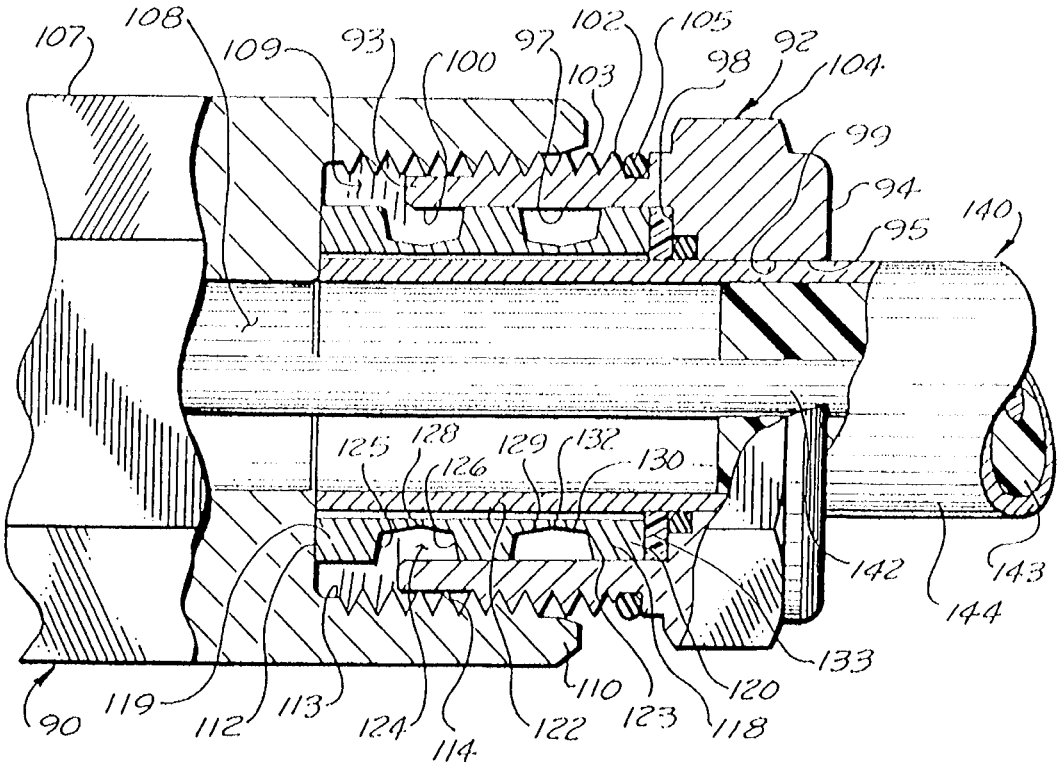
FIG. 7 is a cross-sectional side view of a further embodiment of a coaxial cable connector with an unsecured coaxial cable inserted therein.

Referring now to FIG. 7, a further embodiment of the instant invention generally designated 90 is illustrated. In this embodiment, connector 90 includes a tubular outer member 92 having an inner end 93 and an outer end 94. A bore 95 extends through outer member 92 from outer end 94, and a counter bore 97 extends into outer member 92 from inner end 93, concentric with bore 95. Counter bore 97 has a greater diameter than bore 95, forming a shoulder 98 therebetween. Outer member 92 has an outer surface 102, an inner surface 99 defining bore 95 and an inner surface 100 defining counter bore 97. Exterior threads 103 are formed on outer surface 102 proximate inner end 93 and a raised portion 104 formed on outer surface 102 proximate outer end 94 acts as a gripping portion for a conventional spanner. An O-ring 105 is located between exterior threads 103 and raised portion 104 of outer surface 102.

A coupling member 107 having a bore 108 extending therethrough and a counter bore 109 extending thereinto concentric with bore 108 from a first end 110 and forming a shoulder 112 therebetween, is attached to inner end 93 of outer member 92. Counter bore 109 is defined by an inner surface 113 having inner threads 114 formed thereon. Inner threads 114 of coupling member 107 engage exterior threads 103 of outer member 92.

Securement means, in this embodiment, consists of a cylindrical body 118 having an inner end 119 in the direction towards coupling member 107, an outer end 120, an inner surface 122 defining a bore 121, and an outer surface 123. Inner surface 122 is generally cylindrical and has a substantially uniform diameter, coplanar with inner surface 99 of bore 95. Outer surface 123 is generally cylindrical having a substantially uniform diameter, with parallel compression grooves 124. Compression grooves 124 are each defined by sidewalls 125 and 126, and a bottom 128. Bottom 128 includes a first half 129 and a second half 130, each extending from sidewalls 125 and 126, respectively, and sloping inward toward inner surface 122. First half 129 and second half 130 join at a central joint 132 midway between sidewall 125 and 126. Cylindrical body 118 is carried by counter bore 97 of outer member 92. A compression washer 133 is positioned between outer end 120 of cylindrical body 118 and shoulder 98 of outer member 92. In its uncompressed configuration, cylindrical body 118 is carried by counter bore 97 of outer member 92 between shoulder 112 of coupling member 107 and compression washer 133.

This embodiment would be used with a coaxial cable 140 having a center conductor 142 encased in a cylindrical dielectric 143. An outer conductor 144, typically of a deformable metallic material, encircles cylindrical dielectric 143. Still referring to FIG. 7, coaxial cable 140 is received in bore 95 of outer member 92, and bore 121 of cylindrical body 118, with outer conductor 144 substantially flush with inner surface 99 of bore 95 and inner surface of cylindrical body 118.

Figure 8:
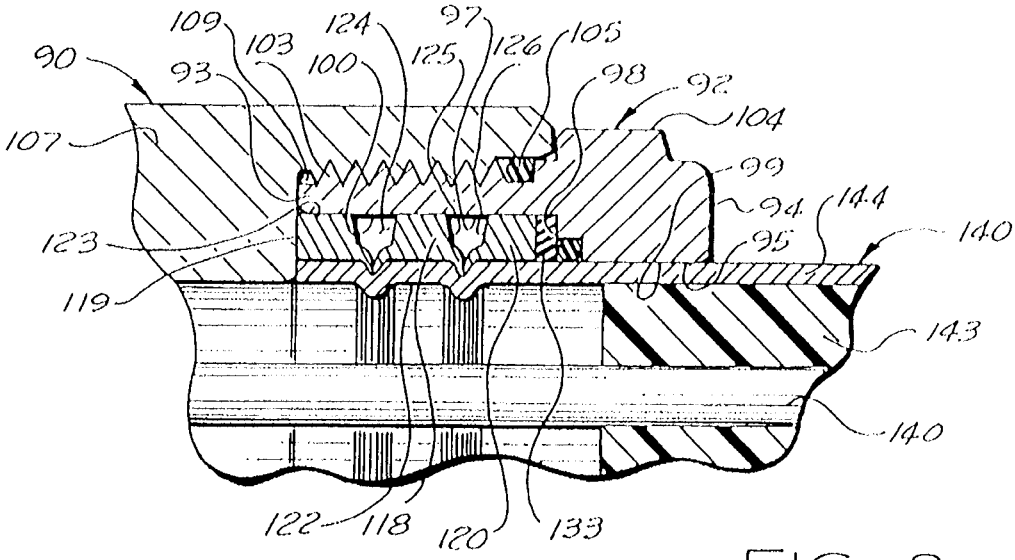
FIG. 8 is a fragmentary cross-sectional side view of the coaxial cable connector illustrated in FIG. 7 with the coaxial cable securely coupled therein by the securement means.

The attachment of coaxial cable 140 to connector 90 is illustrated in FIG. 8. Coaxial cable 140 is received by connector 90 as illustrated in FIG. 7, and securely held in place by cylindrical body 118 means. Outer member 92 is threadably inserted into coupling member 107, axially compressing cylindrical body 118 between shoulder 112 of coupling member 107 and compression washer 133. Bottom 128 is compressed forcing first half and second half 129 and 130 substantially uniformly radially inward against coaxial cable 140, deforming outer conductor 144 around its entire circumference, and resulting in a mechanical and sealing engagement between the securement member and coaxial cable 140.

Various changes and modifications to the embodiments herein chosen for purposes of illustration will readily occur to those skilled in the art. For example, while the coupling member is generally illustrated as nut 23, it will be understood that any conventional coupling member may be employed, including connectors of the embodiments herein disclosed, for splicing coaxial cables. It is also noted that the improvements, specifically the securement members, can be practiced with conventional prior art connectors other than the specific type chosen for purposes of illustration. To the extent that such modifications and variations do not depart from the spirit of the invention, they are intended to be included within the scope of the following claims:

I claim:

1. The invention claimed is a connector for securing a coaxial cable to a selected device comprising:

an outer member having a bore for receiving said coaxial cable, a free end and an inner end;

a coupling member attached to said inner end of said outer member for securing said coaxial cable to a selected device; and a securement means carried by said outer member including a compression groove being deformable in a substantially uniform radially inward direction for mechanically and sealingly engaging said coaxial cable in response to a longitudinal compressive force.

2. A connector as claimed in claim 1 wherein said securement means further includes;

a cylindrical body having an outer surface, and inner surface defining a bore for receiving said coaxial cable, an outer end and an inner end;

said compression groove formed in said outer surface of said cylindrical body; and said cylindrical body received in said bore of said outer member.

3. A connector as claimed in claim 1 wherein said compression groove is formed in an outer surface of said outer member.

4. A connector as claimed in claim 3 wherein said compression groove includes a bottom having sides sloping radially inward to a central joint.

5. A connector as claimed in claim 2 wherein said cylindrical body is press fit in said outer member, with said outer end of said cylindrical body extending beyond said free end of said outer member.

6. A connector as claimed in claim 5 wherein said compression groove includes a bottom having sides sloping radially inward to a central joint.

7. A connector as claimed in claim 2 wherein said cylindrical body is positioned between said coupling member and said outer member.

8. A connector as claimed in claim 7 wherein said coupling member is threadably attachable to said inner end of said outer member, and said cylindrical body is held in said outer member proximate said inner end by said coupling member.

9. A connector as claimed in claim 8 wherein said compression groove includes a bottom having sides sloping radially inward to a central joint.

* * * * *

Disclaimer 5,525,076 - William J. Down, Phoenix, Arizona. LONGITUDINALLY COMPRESSIBLE COAXIAL CABLE CONNECTOR. Patent dated June 11, 1996. Disclaimer filed October 25, 1999, by the assignee, Gilbert Engineering Co., Inc.

The term of this patent shall not extend beyond the expiration date of Pat. No. 5,466,173.

(*Official Gazette,* December 28, 1999)